US011377964B2

(12) United States Patent
Arisi et al.

(10) Patent No.: US 11,377,964 B2
(45) Date of Patent: Jul. 5, 2022

(54) AIRFOIL WITH COOLING PASSAGE NETWORK HAVING ARCED LEADING EDGE

(71) Applicant: United Technologies Corporation, Farmington, CT (US)

(72) Inventors: Allan N. Arisi, Manchester, CT (US); Tracy A. Propheter-Hinckley, Rocky Hill, CT (US)

(73) Assignee: RAYTHEON TECHNOLOGIES CORPORATION, Farmington, CT (US)

( * ) Notice: Subject to any disclaimer, the term of this patent is extended or adjusted under 35 U.S.C. 154(b) by 275 days.

(21) Appl. No.: 16/594,328

(22) Filed: Oct. 7, 2019

(65) Prior Publication Data

US 2020/0332665 A1 Oct. 22, 2020

Related U.S. Application Data

(60) Provisional application No. 62/757,980, filed on Nov. 9, 2018.

(51) Int. Cl.
*F01D 5/18* (2006.01)

(52) U.S. Cl.
CPC ..... *F01D 5/187* (2013.01)

(58) Field of Classification Search
None
See application file for complete search history.

(56) References Cited

U.S. PATENT DOCUMENTS

| | | | | |
|---|---|---|---|---|
| 5,931,638 | A * | 8/1999 | Krause | F01D 5/186 416/97 R |
| 7,520,723 | B2 * | 4/2009 | Liang | F01D 5/187 416/97 R |
| 8,858,159 | B2 | 10/2014 | Piggush et al. | |
| 9,011,077 | B2 * | 4/2015 | Vitt | F01D 5/186 415/115 |
| 9,115,590 | B2 | 8/2015 | Spangler et al. | |
| 9,296,039 | B2 * | 3/2016 | Propheter-Hinckley | B22C 9/10 |
| 9,404,369 | B2 | 8/2016 | Propheter-Hinckley et al. | |
| 9,669,458 | B2 | 6/2017 | Weber et al. | |

(Continued)

FOREIGN PATENT DOCUMENTS

| | | |
|---|---|---|
| EP | 1288438 | 3/2003 |
| EP | 1916388 | 4/2008 |

(Continued)

OTHER PUBLICATIONS

European Search Report for European Patent Application No. 19208027.3 completed Jan. 15, 2020.

*Primary Examiner* — Kayla Mccaffrey
(74) *Attorney, Agent, or Firm* — Carlson, Gaskey & Olds, P.C.

(57) ABSTRACT

An airfoil includes an airfoil section that has an airfoil wall that defines an arced leading end, a trailing end, and first and second sides that join the arced leading end and the trailing end. The first and second sides span in a longitudinal direction between first and second ends. The airfoil wall circumscribes an internal core cavity. There is an arced rib in the internal core cavity. A cooling passage network is embedded in the airfoil wall between inner and outer portions of the airfoil wall. The cooling passage network has a trailing edge and an arced leading edge.

19 Claims, 4 Drawing Sheets

(56) References Cited

U.S. PATENT DOCUMENTS

| | | | | |
|---|---|---|---|---|
| 10,053,990 | B2 | 8/2018 | Weber et al. | |
| 2005/0025623 | A1 | 2/2005 | Botrel et al. | |
| 2005/0031452 | A1* | 2/2005 | Liang | F01D 5/187 416/97 R |
| 2016/0194964 | A1 | 7/2016 | Vu et al. | |
| 2016/0230596 | A1 | 8/2016 | Hagan et al. | |
| 2018/0156043 | A1 | 6/2018 | Clum et al. | |

FOREIGN PATENT DOCUMENTS

| | | |
|---|---|---|
| EP | 2940248 | 11/2015 |
| WO | 2012145121 | 10/2012 |

* cited by examiner

AIRFOIL WITH COOLING PASSAGE NETWORK HAVING ARCED LEADING EDGE

CROSS-REFERENCE TO RELATED APPLICATION

This application claims priority to U.S. Provisional Application No. 62/757,980 filed Nov. 9, 2018.

BACKGROUND

A gas turbine engine typically includes a fan section, a compressor section, a combustor section and a turbine section. Air entering the compressor section is compressed and delivered into the combustion section where it is mixed with fuel and ignited to generate a high-speed exhaust gas flow. The high-speed exhaust gas flow expands through the turbine section to drive the compressor and the fan section. The compressor section typically includes low and high pressure compressors, and the turbine section includes low and high pressure turbines.

The high pressure turbine drives the high pressure compressor through an outer shaft to form a high spool, and the low pressure turbine drives the low pressure compressor through an inner shaft to form a low spool. The fan section may also be driven by the low inner shaft. A direct drive gas turbine engine includes a fan section driven by the low spool such that the low pressure compressor, low pressure turbine and fan section rotate at a common speed in a common direction.

SUMMARY

An airfoil according to an example of the present disclosure includes an airfoil section that has an airfoil wall that defines an arced leading end, a trailing end, and first and second sides that joins the arced leading end and the trailing end. The first and second sides span in a longitudinal direction between first and second ends. The airfoil wall circumscribes an internal core cavity, an arced rib in the internal core cavity, and a cooling passage network embedded in the airfoil wall between inner and outer portions of the airfoil wall. The cooling passage network has a trailing edge and an arced leading edge.

In a further embodiment of any of the foregoing embodiments, the arced leading edge of the cooling passage network is axially coincident with the arced rib along the longitudinal direction.

In a further embodiment of any of the foregoing embodiments, the cooling passage network includes a plurality of segmented longitudinally-elongated ribs.

In a further embodiment of any of the foregoing embodiments, each said segmented longitudinally-elongated rib includes longitudinally-elongated segments.

In a further embodiment of any of the foregoing embodiments, each said segmented longitudinally-elongated rib defines a central midline, and each said longitudinally-elongated segment has a uniform thickness along the central midline in a direction perpendicular to the central midline.

In a further embodiment of any of the foregoing embodiments, each said longitudinally-elongated segment defines a segment length and the uniform thickness is over 90% or more of the segment length.

In a further embodiment of any of the foregoing embodiments, each said segmented longitudinally-elongated rib defines a central midline, and each said longitudinally-elongated segment has a non-uniform thickness along the central midline in a direction perpendicular to the central midline.

In a further embodiment of any of the foregoing embodiments, each said longitudinally-elongated segment defines a segment length and the non-uniform thickness is over 90% or more of the segment length.

In a further embodiment of any of the foregoing embodiments, the cooling passage network includes longitudinally-elongated passages.

In a further embodiment of any of the foregoing embodiments, at least one of the longitudinally-elongated passages is a diverging-converging passage.

In a further embodiment of any of the foregoing embodiments, the diverging-converging passage includes a divergent section that spans from the first end of the airfoil wall to an intermediate span location of the airfoil section, and a convergent section that spans from the intermediate span location to the second end of the airfoil wall.

In a further embodiment of any of the foregoing embodiments, the trailing end is straight.

A gas turbine engine according to an example of the present disclosure includes a compressor section, a combustor in fluid communication with the compressor section, and a turbine section in fluid communication with the combustor. The turbine section has a turbine airfoil according to any of the foregoing embodiments.

In a further embodiment of any of the foregoing embodiments, the arced leading edge of the cooling passage network is axially coincident with the arced rib along the longitudinal direction.

In a further embodiment of any of the foregoing embodiments, the cooling passage network includes a plurality of segmented longitudinally-elongated ribs.

In a further embodiment of any of the foregoing embodiments, each said segmented longitudinally-elongated rib includes longitudinally-elongated segments.

In a further embodiment of any of the foregoing embodiments, each said segmented longitudinally-elongated rib defines a central midline, and each said longitudinally-elongated segment has a uniform thickness along the central midline in a direction perpendicular to the central midline.

In a further embodiment of any of the foregoing embodiments, each said segmented longitudinally-elongated rib defines a central midline, and each said longitudinally-elongated segment has a non-uniform thickness along the central midline in a direction perpendicular to the central midline.

BRIEF DESCRIPTION OF THE DRAWINGS

The various features and advantages of the present disclosure will become apparent to those skilled in the art from the following detailed description. The drawings that accompany the detailed description can be briefly described as follows.

DETAILED DESCRIPTION

Figure 1:
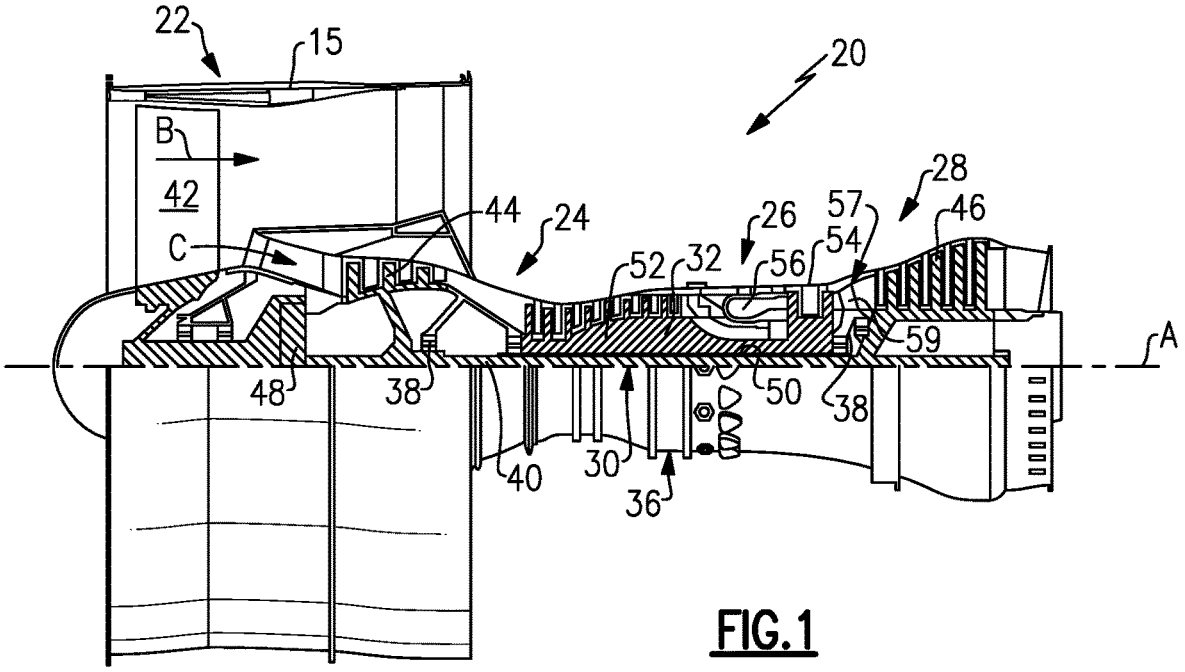
FIG. 1 illustrates a gas turbine engine.

FIG. 1 schematically illustrates a gas turbine engine 20. The gas turbine engine 20 is disclosed herein as a two-spool turbofan that generally incorporates a fan section 22, a compressor section 24, a combustor section 26 and a turbine section 28. The fan section 22 drives air along a bypass flow path B in a bypass duct defined within a nacelle 15, and also drives air along a core flow path C for compression and communication into the combustor section 26 then expansion through the turbine section 28. Although depicted as a two-spool turbofan gas turbine engine in the disclosed non-limiting embodiment, it should be understood that the concepts described herein are not limited to use with two-spool turbofans as the teachings may be applied to other types of turbine engines including three-spool architectures.

The exemplary engine 20 generally includes a low speed spool 30 and a high speed spool 32 mounted for rotation about an engine central longitudinal axis A relative to an engine static structure 36 via several bearing systems 38. It should be understood that various bearing systems 38 at various locations may alternatively or additionally be provided, and the location of bearing systems 38 may be varied as appropriate to the application.

The low speed spool 30 generally includes an inner shaft 40 that interconnects, a first (or low) pressure compressor 44 and a first (or low) pressure turbine 46. The inner shaft 40 is connected to the fan 42 through a speed change mechanism, which in exemplary gas turbine engine 20 is illustrated as a geared architecture 48 to drive a fan 42 at a lower speed than the low speed spool 30. The high speed spool 32 includes an outer shaft 50 that interconnects a second (or high) pressure compressor 52 and a second (or high) pressure turbine 54. A combustor 56 is arranged in exemplary gas turbine 20 between the high pressure compressor 52 and the high pressure turbine 54. A mid-turbine frame 57 of the engine static structure 36 may be arranged generally between the high pressure turbine 54 and the low pressure turbine 46. The mid-turbine frame 57 further supports bearing systems 38 in the turbine section 28. The inner shaft 40 and the outer shaft 50 are concentric and rotate via bearing systems 38 about the engine central longitudinal axis A which is collinear with their longitudinal axes.

The core airflow is compressed by the low pressure compressor 44 then the high pressure compressor 52, mixed and burned with fuel in the combustor 56, then expanded over the high pressure turbine 54 and low pressure turbine 46. The mid-turbine frame 57 includes airfoils 59 which are in the core airflow path C. The turbines 46, 54 rotationally drive the respective low speed spool 30 and high speed spool 32 in response to the expansion. It will be appreciated that each of the positions of the fan section 22, compressor section 24, combustor section 26, turbine section 28, and fan drive gear system 48 may be varied. For example, gear system 48 may be located aft of the low pressure compressor, or aft of the combustor section 26 or even aft of turbine section 28, and fan 42 may be positioned forward or aft of the location of gear system 48.

The engine 20 in one example is a high-bypass geared aircraft engine. In a further example, the engine 20 bypass ratio is greater than about six (6), with an example embodiment being greater than about ten (10), the geared architecture 48 is an epicyclic gear train, such as a planetary gear system or other gear system, with a gear reduction ratio of greater than about 2.3 and the low pressure turbine 46 has a pressure ratio that is greater than about five. In one disclosed embodiment, the engine 20 bypass ratio is greater than about ten (10:1), the fan diameter is significantly larger than that of the low pressure compressor 44, and the low pressure turbine 46 has a pressure ratio that is greater than about five 5:1. Low pressure turbine 46 pressure ratio is pressure measured prior to inlet of low pressure turbine 46 as related to the pressure at the outlet of the low pressure turbine 46 prior to an exhaust nozzle. The geared architecture 48 may be an epicycle gear train, such as a planetary gear system or other gear system, with a gear reduction ratio of greater than about 2.3:1 and less than about 5:1. It should be understood, however, that the above parameters are only exemplary of one embodiment of a geared architecture engine and that the present invention is applicable to other gas turbine engines including direct drive turbofans.

A significant amount of thrust is provided by the bypass flow B due to the high bypass ratio. The fan section 22 of the engine 20 is designed for a particular flight condition—typically cruise at about 0.8 Mach and about 35,000 feet (10,668 meters). The flight condition of 0.8 Mach and 35,000 ft (10,668 meters), with the engine at its best fuel consumption—also known as "bucket cruise Thrust Specific Fuel Consumption ('TSFC')"—is the industry standard parameter of lbm of fuel being burned divided by lbf of thrust the engine produces at that minimum point. "Low fan pressure ratio" is the pressure ratio across the fan blade alone, without a Fan Exit Guide Vane ("FEGV") system. The low fan pressure ratio as disclosed herein according to one non-limiting embodiment is less than about 1.45. "Low corrected fan tip speed" is the actual fan tip speed in ft/sec divided by an industry standard temperature correction of [(Tram ° R)/(518.7° R)]^0.5. The "Low corrected fan tip speed" as disclosed herein according to one non-limiting embodiment is less than about 1150 ft/second (350.5 meters/second).

Figure 2:
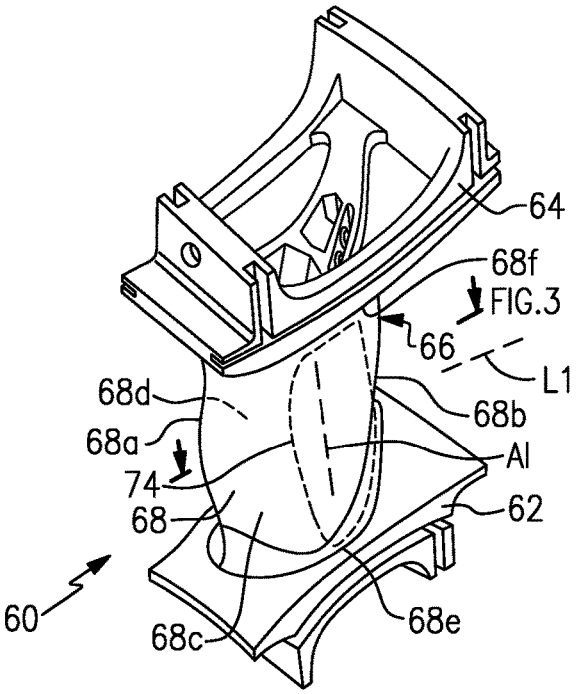
FIG. 2 illustrates an airfoil of the gas turbine engine of FIG. 1.
Figure 3:
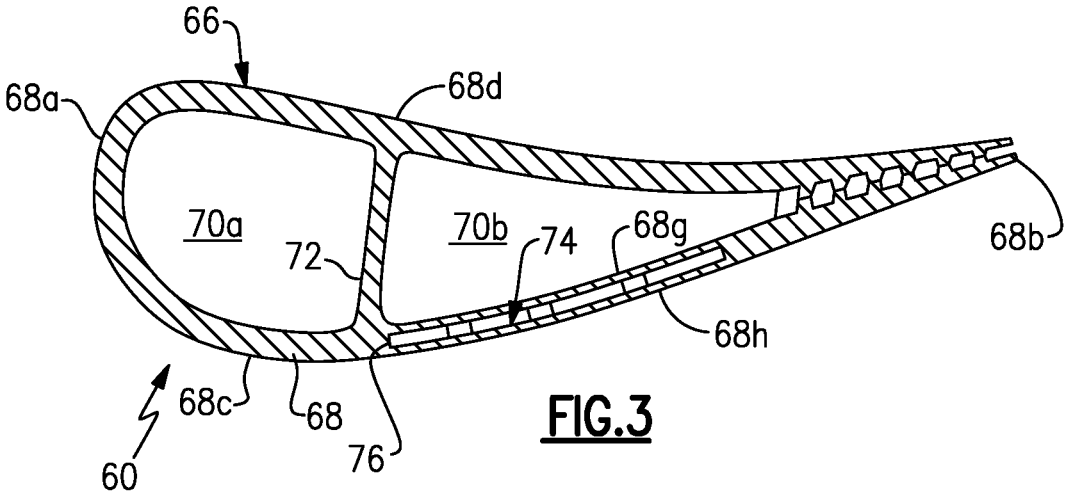
FIG. 3 illustrates a sectioned view of the airfoil of FIG. 2.
Figure 4:
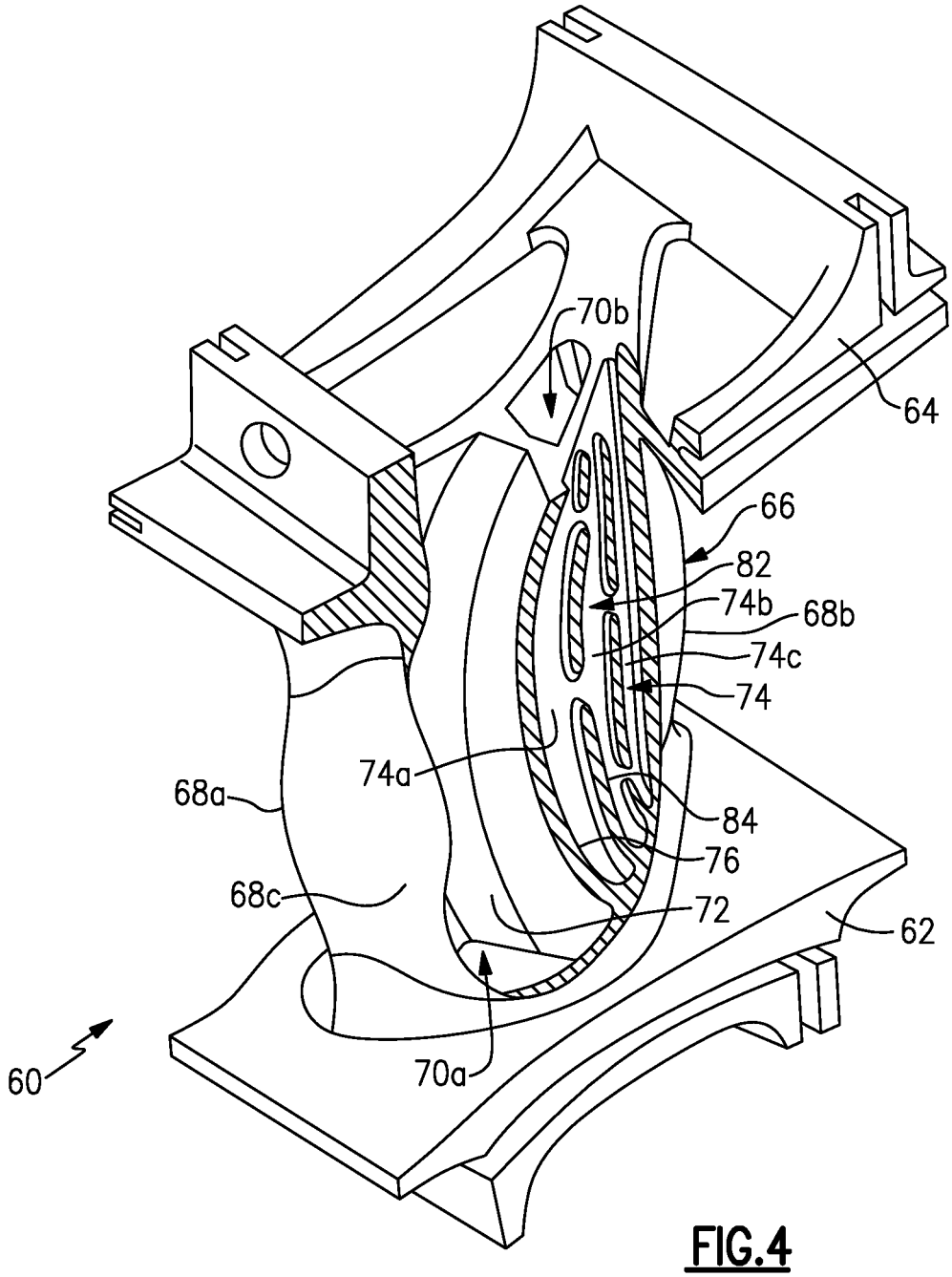
FIG. 4 illustrates a partial cutaway view of the airfoil of FIG. 2.

FIG. 2 illustrates a representative example of a turbine airfoil 60 used in the turbine engine 20 (see also FIG. 1), FIG. 3 shows a sectioned view of the airfoil 60, and FIG. 4 shows a partial cutaway view of the airfoil 60. As shown, the turbine airfoil 60 is a turbine vane; however, it is to be understood that, although the examples herein may be described with reference to the turbine vane, this disclosure is also applicable to turbine blades.

The turbine airfoil 60 includes an inner or first platform 62, an outer or second platform 64, and an airfoil section 66 that radially spans between the inner and outer platforms 62/64. Terms such as "radially," "axially," or variations thereof are used herein to designate directionality with respect to the engine central axis A.

The airfoil section 66 includes an airfoil outer wall 68 that delimits the profile of the airfoil section 66. The outer wall 68 defines an arced leading end 68*a*, a trailing end 68*b*, and first and second sides 68*c*/68*d* that join the leading and trailing ends 68*a*/68*b*. The first and second sides 68*c*/68*d* span in a longitudinal direction, denoted by axis A1 (which is also a radial direction relative to the engine central axis A), between first and second ends 68*e*/68*f*. The first and second ends 68*e*/68*f* are attached, respectively, to the first and second platforms 62/64. In this example, the first side 68*c* is a suction side and the second side 68*d* is a pressure side.

In this example, the arced leading end 68*a* is convex with respect to the axial middle of the airfoil section 66. That is, the convex leading end 68*a* bows outwards relative to the middle of the airfoil section 66. It is also contemplated that the present disclosure can be applied to airfoils with concave leading ends. In the illustrated example, the trailing end 68*b* is straight but may alternatively be arced, such as convex.

The outer wall 68 of the airfoil section 66 circumscribes an internal core cavity 70. The airfoil section 66 further includes an arced rib 72 in the internal core cavity 70. The arced rib 72 arcs toward the arced leading end 68*a*. For example, the arced rib 72 substantially follows the curvature of the arced leading end 68*a*. In further examples, the arced rib 72 and is semi-circular and the arced leading end 68*a* is semi-circular. In one example, the arced rib 72 and the arced leading end 68*a* each have a radius of curvature, and the radii of curvatures are equal.

The arced rib 72 partitions the internal core cavity 70, dividing the cavity 70 into a forward cavity 70*a* and an aft cavity 70*b*. In this example, the arced rib 72 extends from the first side 68*c* to the second side 68*d* and is solid and free of any orifices. The arced rib 72 thereby fluidly isolates the forward and aft cavities 70*a*/70*b* of the internal core cavity 70.

There is at least one cooling passage network 74 embedded in the airfoil outer wall 68 between inner and outer portions 68*g*/68*h* of the airfoil wall 68. For example, the cooling passage network 74 is embedded in the first side 68*c* of the outer wall 68, although one or more networks 74 could additionally or alternatively be embedded in the second side 68*d*. The cooling passage network 74 may also be referred to as a skincore or skincore passage. A "skincore" or "skincore passage" is a reference to the thin investment casting core or cores that is/are typically used to make such embedded passages, as opposed to a main core that is used to form a main or central core cavity in an airfoil.

The shape of the airfoil section 66 and, in particular the arced leading end 68*a*, are designed for aerodynamic performance. However, the arced leading end 68*a* and arced rib 72 challenge the use of a skincore or skincore passage for enhanced cooling. More specifically, a typical airfoil section for a turbine airfoil of a gas turbine engine has a straight leading end, a straight rib, and a skincore passage with a straight leading edge along the margin of the rib. Thus, the wall portion between the leading edge of the skincore passage and the margin of rib is of relatively constant in thickness along the entirety of the radial span of the skincore passage. However, for an arced rib, the wall portion between the straight leading edge of the skincore passage and the margin of arced rib has a D-shaped thickness along the radial span of the skincore passage. The middle part of the D-shaped wall portion is thicker than at the ends and thus can be challenging to properly cool.

Figure 5:
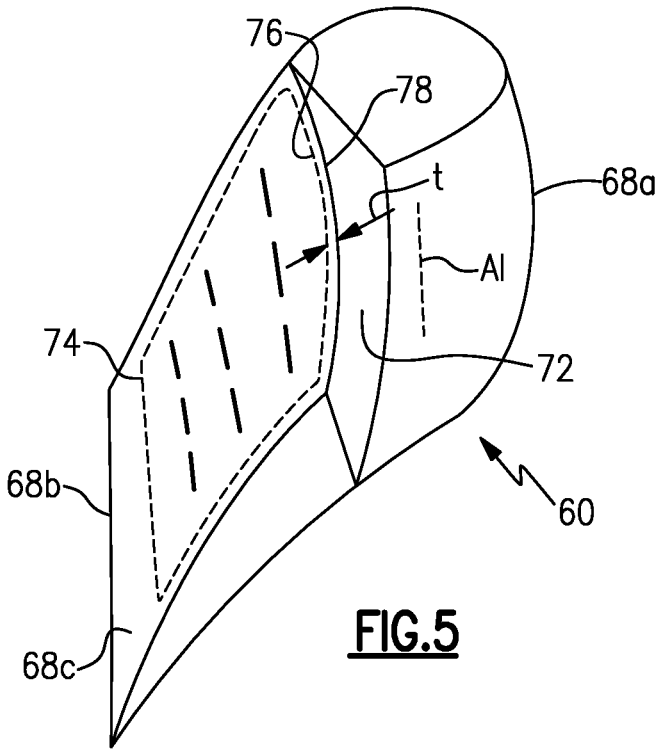
FIG. 5 is a schematic illustration of an airfoil showing an arced leading edge of a cooling passage network.

In this regard, as schematically depicted in FIG. 5, the disclosed network 74 has an arced leading edge 76 to avoid such a thicker wall portion, thereby enabling enhanced cooling in combination with the arced leading end 68*a* and arced rib 72. For example, the arced leading edge 76 is axially coincident with the arced rib 72 along the longitudinal direction A1 such that a wall portion 78 between the arced leading edge 76 of the network 74 and the margin of the arced rib 72 is of relatively constant in thickness (t) along the entirety of the radial span of the network 74. That is, the arced leading edge follows the curvature of the arced rib 72.

Figure 6:
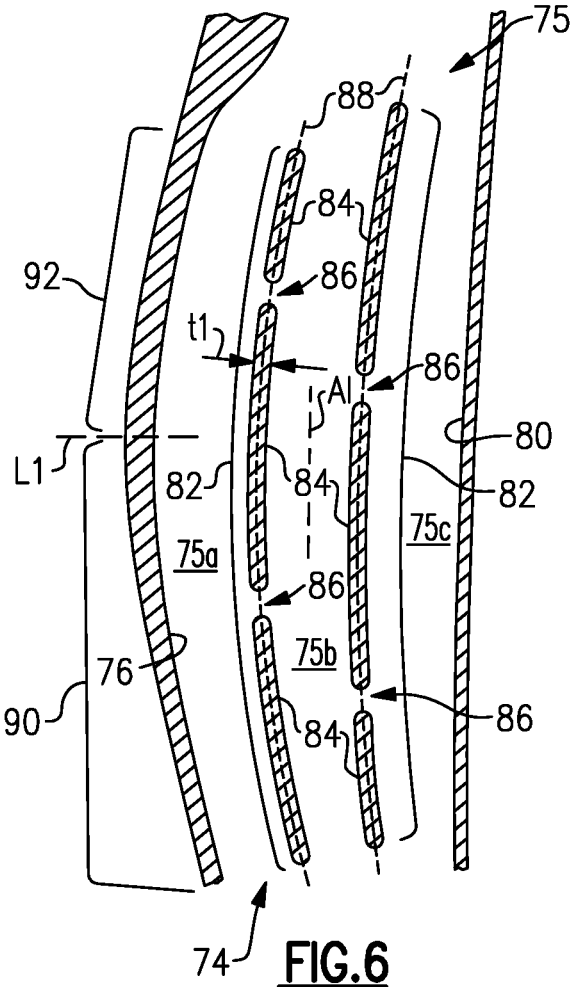
FIG. 6 illustrates a cooling passage network of an airfoil that has uniform thickness ribs.

FIG. 6 illustrates a magnified view of selected portions of the network 74 to demonstrate an example configuration of the network 74. The network 74 defines a thin cavity 75 that is bound axially by a trailing edge 80 and the arced leading edge 76 and laterally by the inner and outer wall portions 68*g*/68*h* (FIG. 3). In the illustrated example, the trailing edge 80 is straight and, together with the leading edge 76, provides the cavity 75 with a general D-shaped geometry. Alternatively, if the trailing end 68*b* of the airfoil section 66 is arced, the trailing edge 80 is arced to follow the arc of the trailing end 68*b*.

The radially inner and outer ends of the cavity 75 may be open or include orifices or the like for conveying cooling air. For example, the cavity 75 opens into or is fluidly connected with cavities in the first and second platforms 62/64 that serve to deliver cooling air to, and receive cooling air from, the cavity 75.

The network 74 includes a plurality of segmented longitudinally-elongated ribs 82 (hereafter "ribs 82"). In the example shown, each rib 82 is of made up of longitudinally-elongated segments 84 ("segments 84"). The segments 84 of each rib 82 are generally longitudinally aligned end-to-end, but are not in contact. Rather, there are gaps 86 between the segments 84. Each rib 82 defines a central midline 88 along which its segments 84 are arranged. In this example, each segment 84 has a uniform thickness (t1) along the central midline 88 in a direction perpendicular to the central midline 88. Each segment 84 is of the uniform thickness (t1) over substantially its entire longitudinal length. For instance, each segment has the uniform thickness (t1) over 90% or more of its longitudinal length.

The ribs 82 partition the cavity 75 into longitudinally-elongated passages 75*a*/75*b*/75*c*. In this example, the passage 75*a* is the leading or forward-most passage, the passage 75*c* is the aft or aft-most passage, and the passage 75*b* is an intermediate passage that is axially between the passages 75*a*/75*c*. As will be appreciated, additional or fewer passages can be provided.

The ribs 82 are generally arced, but transition in the degree of arc from the arced leading edge 76 to the trailing edge 80, which is straight. The degree or amount of arc may be indicated by a radius of curvature. For instance, the forward one of the ribs 82 adjacent the leading edge 76 has a lower radius of curvature than the arced leading edge 76. The aft one of the ribs 82 adjacent the trailing edge 80 has a lower radius of curvature than the arced leading edge 76 and the forward rib 82. In one example, the aft rib 82 may be straight.

Due to the arced shape of the arced leading edge 76 and rib or ribs 82, the passages 75*a*/75*b*/75*c* may also have an arced shape. However, since the ribs 82 transition in the amount of arc, and are of uniform thickness t1, one or more of the passages 75*a*/75*b*/75*c* may bulge somewhat in the middle. That is, at least one of the passages 75*a*/75*b*/75*c* is a diverging-converging passage. For instance, in the example shown, the passage 75*a* is a diverging-converging passage. The passage 75*a* includes a divergent section 90 that spans from a terminal end of the rib 82 to an intermediate span location L1 of the airfoil section 66, and a convergent section 92 that spans from the intermediate span location L1 to the opposite terminal end of the rib 82. As an example, L1 is located in the middle one-third of the full span of the airfoil section 66. The diverging-converging passage shape influences heat transfer in the network 74. For instance, the cooling air flow slows down and diffuses in the divergent section 90 but speeds up in the convergent section 92.

Figure 7:
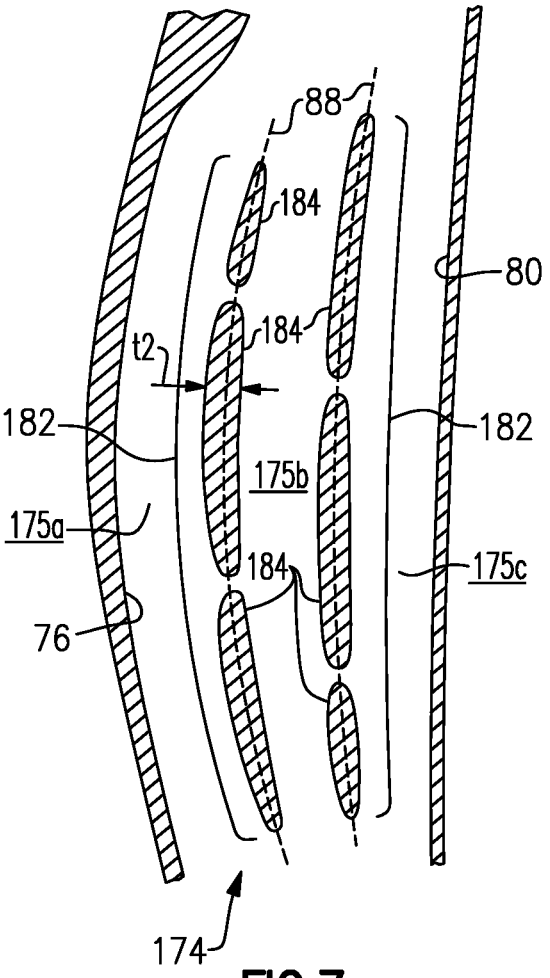
FIG. 7 illustrates another example of a cooling passage network that has non-uniform thickness ribs.

FIG. 7 illustrates another example of a cooling passage network 174. In this example, the segmented longitudinally-elongated ribs 182 are made up of longitudinally-elongated segments 184 that define the passages 175*a*/175*b*/175*c*. Unlike the segments 84, each segment 184 has a non-uniform thickness (t2) along the central midline 88 in a direction perpendicular to the central midline 88. Each segment 184 is of the non-uniform thickness (t2) over substantially its entire longitudinal length. For instance, each segment 184 has the non-uniform thickness (t2) over 90% or more of its longitudinal length.

Due to the arced shape of the arced leading edge 76 and rib or ribs 182, the passages 175*a*/175*b*/175*c* may also have an arced shape. However, the non-uniform thickness t2 of the ribs 182 is such that the passages 175*a*/175*b*/175*c* are of uniform thickness. That is, each passage 175*a*/175*b*/175*c* maintains a constant cross-section throughout its length. The uniform passage shape influences heat transfer in the network 174. For instance, the cooling air flow does not substantially slow down or speed up in the passages 175*a*/175*b*/175*c*, although the relatively thicker segments 182 will require adequate heat removal.

Although a combination of features is shown in the illustrated examples, not all of them need to be combined to realize the benefits of various embodiments of this disclosure. In other words, a system designed according to an embodiment of this disclosure will not necessarily include all of the features shown in any one of the Figures or all of the portions schematically shown in the Figures. Moreover, selected features of one example embodiment may be combined with selected features of other example embodiments.

The preceding description is exemplary rather than limiting in nature. Variations and modifications to the disclosed examples may become apparent to those skilled in the art that do not necessarily depart from this disclosure. The scope of legal protection given to this disclosure can only be determined by studying the following claims.

What is claimed is:

1. An airfoil comprising:

an airfoil section having an airfoil wall defining an arced leading end, a trailing end, and first and second sides joining the arced leading end and the trailing end, the first and second sides spanning in a longitudinal direction between first and second ends, the airfoil wall circumscribing an internal core cavity, and the trailing end being straight;

an arced rib in the internal core cavity; and a cooling passage network embedded in the airfoil wall between inner and outer portions of the airfoil wall, the cooling passage network having a trailing edge and an arced leading edge, the arched leading end, the arced rib, and the arced leading edge of the cooling passage network being arced such that profiles of the arched leading end, the arced rib, and the arced leading edge when taken in a radial cross-section are arced.

2. The airfoil as recited in claim 1, wherein the arced leading edge of the cooling passage network is axially coincident with the arced rib along the longitudinal direction.

3. The airfoil as recited in claim 1, wherein the cooling passage network includes a plurality of segmented longitudinally-elongated ribs.

4. The airfoil as recited in claim 3, wherein each said segmented longitudinally-elongated rib includes longitudinally-elongated segments.

5. The airfoil as recited in claim 4, wherein each said segmented longitudinally-elongated rib defines a central midline, and each said longitudinally-elongated segment has a uniform thickness along the central midline in a direction perpendicular to the central midline.

6. The airfoil as recited in claim 5, wherein each said longitudinally-elongated segment defines a segment length and the uniform thickness is over 90% or more of the segment length.

7. The airfoil as recited in claim 4, wherein each said segmented longitudinally-elongated rib defines a central midline, and each said longitudinally-elongated segment has a non-uniform thickness along the central midline in a direction perpendicular to the central midline.

8. The airfoil as recited in claim 7, wherein each said longitudinally-elongated segment defines a segment length and the non-uniform thickness is over 90% or more of the segment length.

9. The airfoil as recited in claim 1, wherein the cooling passage network includes longitudinally-elongated passages.

10. The airfoil as recited in claim 9, wherein at least one of the longitudinally-elongated passages is a diverging-converging passage.

11. The airfoil as recited in claim 10, wherein the diverging-converging passage includes a divergent section that spans from the first end of the airfoil wall to an intermediate span location of the airfoil section, and a convergent section that spans from the intermediate span location to the second end of the airfoil wall.

12. A gas turbine engine comprising:

a compressor section;

a combustor in fluid communication with the compressor section; and a turbine section in fluid communication with the combustor, the turbine section having a turbine airfoil that includes an airfoil section having an airfoil wall defining an arced leading end, a trailing end, and first and second sides joining the arced leading end and the trailing end, the first and second sides spanning in a longitudinal direction between first and second ends, the airfoil wall circumscribing an internal core cavity, and the trailing end being straight, an arced rib in the internal core cavity, and a cooling passage network embedded in the airfoil wall between inner and outer portions of the airfoil wall, the cooling passage network having a trailing edge and an arced leading edge, the arched leading end, the arced rib, and the arced leading edge of the cooling passage network being arced such that profiles of the arched leading end, the arced rib, and the arced leading edge when taken in a radial cross-section are arced.

13. The gas turbine engine as recited in claim 12, wherein the arced leading edge of the cooling passage network is axially coincident with the arced rib along the longitudinal direction.

14. The gas turbine engine as recited in claim 12, wherein the cooling passage network includes a plurality of segmented longitudinally-elongated ribs.

15. The gas turbine engine as recited in claim 14, wherein each said segmented longitudinally-elongated rib includes longitudinally-elongated segments.

16. The gas turbine engine as recited in claim 15, wherein each said segmented longitudinally-elongated rib defines a central midline, and each said longitudinally-elongated segment has a uniform thickness along the central midline in a direction perpendicular to the central midline.

17. The gas turbine engine as recited in claim 15, wherein each said segmented longitudinally-elongated rib defines a central midline, and each said longitudinally-elongated segment has a non-uniform thickness along the central midline in a direction perpendicular to the central midline.

18. An airfoil comprising an airfoil section having an airfoil wall defining an arced leading end, a trailing end, and first and second sides joining the arced leading end and the trailing end, the first and second sides spanning in a longitudinal direction between first and second ends, the airfoil wall circumscribing an internal core cavity;

an arced rib in the internal core cavity; and a cooling passage network embedded in the airfoil wall between inner and outer portions of the airfoil wall, the cooling passage network having a trailing edge and an arced leading edge, the arched leading end, the arced rib, and the arced leading edge of the cooling passage network being arced such that profiles of the arched leading end, the arced rib, and the arced leading edge when taken in a radial cross-section are arced, wherein the arced rib is arced forward toward the arced leading end of the airfoil wall such that a portion of the arced rib at an intermediate span of the arced rib is forward of radial ends of the arced rib.

19. The airfoil as recited in claim 18, wherein the profile of the arced rib when taken in an axial cross-section is straight from the first side of the airfoil wall to the second side of the airfoil wall.

* * * * *